United States Patent [19]

Rossopoulos

[11] Patent Number: 4,854,752

[45] Date of Patent: Aug. 8, 1989

[54] CONVERTIBLE PRINT HEAD

[75] Inventor: Stephane Rossopoulos, Yverdon-les-Bains, Switzerland

[73] Assignee: Hermes Precisa Internatinal S.A., Yverdon, Switzerland

[21] Appl. No.: 233,838

[22] Filed: Aug. 15, 1988

Related U.S. Application Data

[63] Continuation of Ser. No. 16,857, Feb. 20, 1987, abandoned.

[30] Foreign Application Priority Data

Mar. 21, 1986 [CH] Switzerland ..... 1157/86

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,759,359 | 9/1973 | Stellmach | 400/124 |
| 4,010,835 | 3/1977 | Martin et al. | 400/124 |
| 4,256,408 | 3/1981 | Shelton | 400/124 |
| 4,260,270 | 4/1981 | Cavallari | 400/124 |
| 4,400,101 | 8/1983 | Hendrischk | 400/124 |
| 4,447,166 | 5/1984 | Ochiai | 400/124 |
| 4,459,051 | 7/1984 | Kawai | 400/124 |
| 4,470,713 | 9/1984 | Rossopoulos | 400/124 |

FOREIGN PATENT DOCUMENTS

| | | | |
|---|---|---|---|
| 75342 | 8/1982 | European Pat. Off. | 400/124 |
| 139190 | 9/1984 | European Pat. Off. | 400/124 |
| 157725 | 2/1985 | European Pat. Off. | 400/124 |
| 2947398 | 5/1981 | Fed. Rep. of Germany | 400/124 |
| 163670 | 9/1983 | Japan | 400/124 |

OTHER PUBLICATIONS

"Displaceble Print Wire Guide"; R. J. Harris; *IBM Tech. Disc. Bull.;* vol. 26, No. 8, p. 3985; Jan. 1984.

*Primary Examiner*—David A. Wiecking

*Attorney, Agent, or Firm*—Gifford, Groh, Sheridan, Sprinkle and Dolgorukov

[57] ABSTRACT

A convertible print head carrying a plurality of needles comprises a rear portion carrying members controlling the needles and a front one portion including a slidable third device at the rear portion. The front one portion includes a front bracket comprising two portions carrying industrial rubies in which are guiding channels for said needles arranged in vertical columns.

A first control device allows a relative displacement between said two portions so as to align or offset the positions of the needles in the columnar arrangements.

A second control device is adapted to displace vertically the two portions simultaneously by means of an electromagnet.

The front bracket is connected to an assembly by means of two flexible blades of the slidable third device.

8 Claims, 1 Drawing Sheet

Fig-1
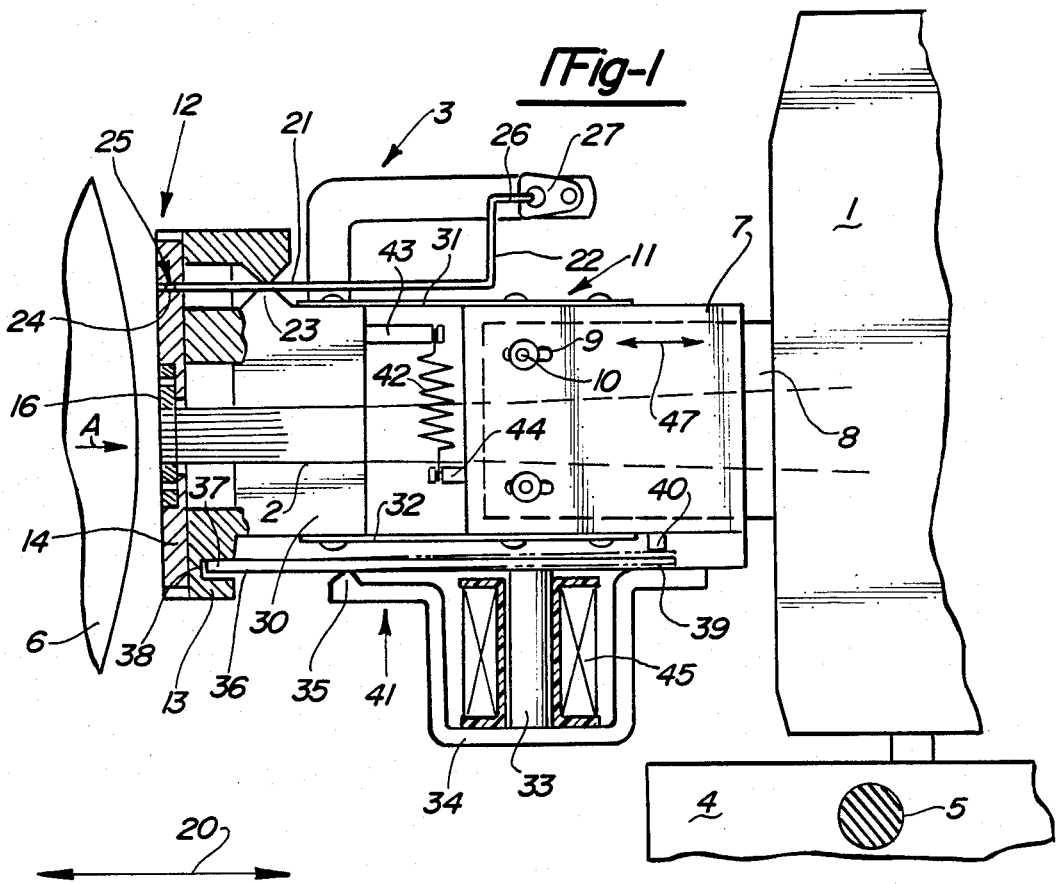
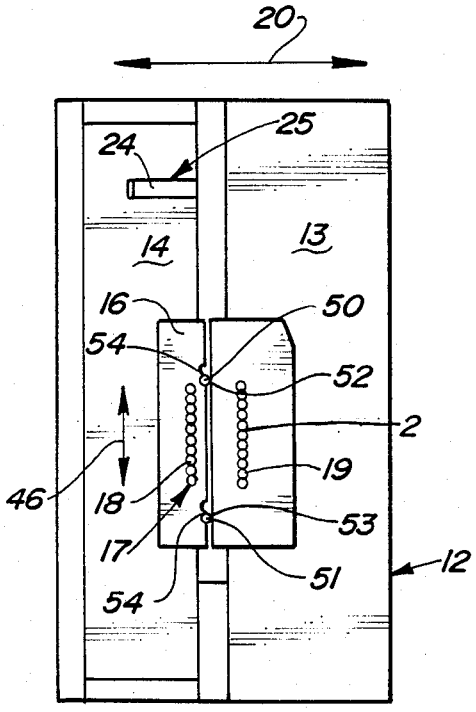
Fig-2
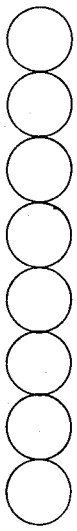
Fig-3a
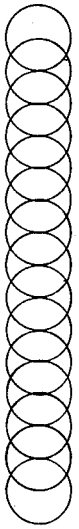
Fig-3b
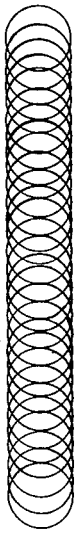
Fig-3c

CONVERTIBLE PRINT HEAD

This is a continuation of co-pending application Ser. No. 16,857 filed on Feb. 20, 1987, now abandoned.

BACKGROUND OF THE INVENTION

1. Field

The present invention relates to printing head and, more particularly, to a high precision needle-type printer head.

2. Prior Art

Needle heads that produce sharp printing are known from the prior art represented by European Pat. No. 0075342 which corresponds to U.S. Pat. No. 4,470,713 to Rossopoulos and by U.S. Pat. No. 4,010,835 to Martin et al wherein the needle heads offset two rows of needles in order to obtain a sharp, clear print.

SUMMARY OF THE INVENTION

A principal object of the present invention is to create a high precision needle-type printer head that is convertible to less clear printing, but which has a high speed printing feature. For that purpose a printing head is comprised of a second device arranged in a manner that displaces the two parts of a front bracket simultaneously according to a first direction, and a third device that effects displacement and adjustment of a two-part front bracket in a direction perpendicular to the first direction and the printing direction.

The many objects and advantages of the present invention will become apparent to those skilled in the art when the following description of the best modes contemplated at present for practicing the invention are read in conjunction with the accompanying drawing, wherein like reference numerals refer to like or equivalent parts.

BRIEF DESCRIPTION OF THE DRAWINGS

In the drawings:

FIG. 1 is a lengthwise sectional view of a printing head in accordance with the present invention;

FIG. 2 is a view in the direction of arrow A of FIG. 1;

FIGS. *3a, 3b, 3c* illustrate the different kinds of print produced by the convertible head of FIG. 1.

DETAILED DESCRIPTION

Referring to FIG. 1, a print head in accordance with the present invention includes a rear portion 1 and a front portion 3 carrying control members for operating needles 2. Such members are not shown since they are well known by persons skilled in the art.

The rear portion 1 is mounted in a movable manner on a carriage 4 sliding on a pair of bars 5 (only one of which pair is shown) arranged in parallel to a striking cylinder 6.

The front portion 3 has an assembly 7 mounted in a slidable manner on a protruding portion 8 attached to the rear portion 1. The assembly 7 has two slots 9 in which are located screws 10 which are so arranged to maintain the front portion 3 in a predetermined position with respect to the rear portion 1, as shown in FIG. 1. The front portion 3 has a front bracket 12 arranged in two portions 13, 14 carrying industrial rubies 15, 16 in which guiding tracks 17 are provided for the needles 2 arranged in a way to form two vertical, spaced apart arrangements 18, 19, as shown in FIG. 2.

Portion 14 is mounted in a sliding manner to move in the direction of arrow 46 thereby allowing a relative displacement between the two portions 13, 14 of the front bracket 12 at will in order to align or offset the needle positions from one vertical needle arrangement with respect to the other vertical needle arrangement according to the printing direction shown by the arrow 20.

A control device 21 to accomplish this relative movement of the two portions 13, 14 comprises a bar 22 pivoting on a fulcrum 23 of the portion 13 of the front bracket 12. One end 24 of the bar 22 is mounted in a slot 25 in portion 14, shown in FIG. 2. The other end 26 of the bar 22 is operated by means of a handle 27 by means of notching as taught in the aforementioned Rossopolous patent, holds the portions in proper alignment.

It is possible to offset the needles 2 of one vertical arrangement 18 with respect to the other vertical arrangement 19 by a distance corresponding to one-half the axial distance between two needles in one by vertical arrangement. The offset is accomplished by affixing two rods 50 and 51 having a diameter corresponding to that of the needles 2 in grooves 52 and 53 of portion 13. A pair of semicircular notches 54 is formed in portion 14 opposite grooves 52 and 53. The notches 54 have the same radius as the grooves 52 and 53, however, the center of curvature for each notch are separated a distance equal to one-half of the diameter of one of the needles 2. The portion 13 may be moved one-half the diameter of one needle with respect to portion 14 by moving the rods 50 and 51 from one of the pair of notches 54 to the other pair.

A rearward extension 30 of portion 13 is connected to the assembly 7 by means of four flexible blades 31, 32 arranged in a vertical direction with respect to FIG. 1.

A control member in the form of an electromagnet 33 is mounted on assembly 7 and includes a body portion 34 having an extension 35 that forms a fulcrum for a control lever 36 portion of the electromagnetic armature of the electromagnet 33. A first end 37 of the lever 36 is mounted in a cavity 38 of the portion 13 of the front bracket 12; the other end 39 being able to operate jointly with an adjustable stop member 40 when the electromagnet 33 is operated, as indicated by the dashed line of FIG. 1, thereby forming a device 41 that displaces simultaneously portions 13 and 14 of the front bracket 12.

Two springs 42 connected to bars 43, 44, that are fixed to portion 13 of the assembly 7, are biased so as to maintain the lever 36 against the stop member 40 when the electromagnet 33 is de-energized.

When electromagnet winding 45 is energized, the two portions 13, 14 of the front bracket 12 are displaced upwards (referring to FIG. 1) by a distance corresponding to one quarter of the axial distance between two needles in one vertical needle arrangement 18 or 19; the end 39 of the lever 36 then resting on the frame 34. The fulcrum 35 is positioned such that the end 37 of lever 36 moves only one-half the distance the other end 39 moves, the vertical movement of which is restricted by the adjustable stop member 40 in one direction and by the frame 34 in the other direction. Thus, the limited proportionate vertical movement of the end 37 with respect to end 39 insures very precise control of the displacement of the front bracket 12.

As shown in figures FIG. *3a*, FIG. *3b* and FIG. *3c*, the printing head of the present invention allows conventional printing that is not particularly sharp, but that is fast (FIG. 3*a*). FIG. 3*b* illustrates sharp printing by offsetting the needles 18, 19 at a normal speed. FIG. 3*c* illustrates very precise printing accomplished by making two passages by one quarter between axes at a normal speed with the two vertical needle arrangements 18, 19 offset by one-half the axial distance.

The print head of the present invention is therefore adaptable to a wide range of applications.

To obtain nearly perfect printing execution, it is necessary that the needles 18, 19 be maintained in the guiding tracks 17 as close as possible to the printing points. The print head, for that purpose, contains a third device 11, shown in FIG. 1, comprising an assembly 7 mounted in a slidable manner on the protruding portion 8 of the rear portion 1 of the head. This assembly 7 allows a precise adjustment of the front side of the rubies 15, 16 with respect to the points of the needles 2 by a displacement of the whole front portion 3 of the head with respect to the rear portion 1.

Also, by removing screw 10, the whole portion 3 of the print head can be removed for the purpose of repairs or whenever the need to exchange it for another portion 3 arises.

Furthermore, the third device 11 has the advantage of allowing the removal of the rear portion 1 that carries the control members for operating the needles 2, without causing the needles 2 to leave their tracks 17, by backing off the front portion 3 before making repairs, for example, so that the needle points extend largely beyond the rubies 15 and 16.

What is claimed is:

1. A convertible needle-type print head comprising two columnar rows of needles mounted on guiding tracks of a front bracket comprised of two portions; first means for permitting relative displacement between said two portions of said front bracket in a vertical first direction for aligning the position of one columnar row of needles with respect to the position of the other columnar row of needles to permit offsetting the relative position of the two columnar rows of needles; second means for moving said two portions of said front bracket simultaneously in said first direction, said front bracket being attached to a first end of at least two flexible members, wherein a first portion of said two portions is mounted slidably on a second portion of said two portions which is attached to said first end of said at least two flexible members, a second end of said at least two flexible members being connected to an assembly part mounted by means of a sliding device slidable in a second direction perpendicular to said first vertical direction to a rear portion of said head, which is rigidly affixed to a printing carriage, said second means comprising a lever mounted to pivot about a pivot located on said assembly part between an electromagnet affixed to said assembly part and said second portion of the front bracket in such a manner that the end of said lever operating jointly with said second portion makes a displacement at least twice as small as an opposite end of said lever when said electromagnet is energized, stop means engageable with said opposite end of said lever for limiting the displacement of said first and second portions.

2. A convertible needle-type print head as in claim 1 in which each needle of said columnar row of needles of said first and second portions has an axis, each axis of needles of a row of needles being separated a predetermined distance, said relative displacement being one-half of said predetermined distance; and wherein said simultaneous displacement of said first and second portions of the front bracket corresponds to one-fourth of said predetermined distance.

3. A convertible needle-type print head comprising:

an assembly slidably mounted on a rear portion of said print head;

at least two flexible members, each of said at least two flexible members attached at one end to said assembly;

a front bracket having a first portion and a second portion, each of said first and second portions having a columnar row of needles mounted on guiding tracks, said first portion mounted to an other end of each of said at least two flexible members, said two flexible members supporting said front bracket for movement in a vertical direction with respect to said rear portion, said second portion slidably mounted on said front bracket with respect to said first portion;

means for permitting a relative first predetermined displacement between said first and second portions of said front bracket in a vertical first direction for aligning the position of one columnar row of needles with respect to the position of said other columnar row of needles to permit offsetting the relative position of said two columnar rows of needles;

means for simultaneously displacing said first and second portions a second predetermined displacement in said vertical direction, said means for displacing comprising a second device having an electromagnet mounted to said head and a lever pivotally mounted to said head, said lever extending between said electromagnet and said first portion, said lever being pivotally mounted to said head so that a first of said lever makes a displacement at least twice as small as a second end of said lever when said electromagnet is energized, said second device further having stop means for limiting the displacement of said second end of said lever when said electromagnet is energized; and means for enabling movable adjustment of the position of said front bracket with respect to said rear portion in a direction normal to said first vertical direction, said means for enabling comprising a third device including said assembly, said assembly selectively movable to adjust the position of said front bracket.

4. A convertible needle-type print head as in claim 3 in which each needle of said columnar row of needles of said first and second portions has an axis, each axis of needles of a row of needles being separated a predetermined distance, said first predetermined displacement being one-half of said predetermined distance; and wherein said second predetermined displacement of said first and second portions of the front bracket corresponds to one-fourth of said predetermined distance.

5. The head of claim 3 including biasing means for urging said lever against said stop means when said electromagnet is energized.

6. The head of claim 3 wherein said means for permitting comprises a bar mounted pivotally on a fulcrum portion of said first portion of said front bracket and arranged to operate jointly with an aperture of said second portion of said front bracket.

7. The head of claim 3 wherein said third device includes one screw slidable in a slot in said assembly whereby said assembly has limited movement with respect to said rear portion.

8. The head of claim 3 wherein said assembly and said rear portion are so fitted as to allow said front bracket to be exchanged with another front bracket.

* * * * *